US008465226B2

(12) United States Patent
Davis

(10) Patent No.: US 8,465,226 B2
(45) Date of Patent: Jun. 18, 2013

(54) CULVERT END

(76) Inventor: Dennis Gordon Davis, Tauranga (NZ)

( * ) Notice: Subject to any disclaimer, the term of this patent is extended or adjusted under 35 U.S.C. 154(b) by 181 days.

(21) Appl. No.: 13/012,069

(22) Filed: Jan. 24, 2011

(65) Prior Publication Data

US 2011/0206461 A1 Aug. 25, 2011

(30) Foreign Application Priority Data

Feb. 22, 2010 (NZ) ..... 583493

(51) Int. Cl.
*E01F 5/00* (2006.01)

(52) U.S. Cl.
USPC ..... 405/125

(58) Field of Classification Search
USPC ..... 405/124–127; 138/109, 119
See application file for complete search history.

(56) References Cited

U.S. PATENT DOCUMENTS

| | | | | | |
|---|---|---|---|---|---|
| 901,702 | A | | 10/1908 | Glasspoole | |
| 3,336,950 | A | | 8/1967 | Fochler | |
| 3,551,007 | A | * | 12/1970 | Martin et al. | 285/133.11 |
| 3,587,239 | A | | 6/1971 | Feland | |
| 3,727,953 | A | * | 4/1973 | Martin et al. | 285/148.23 |
| 4,175,593 | A | * | 11/1979 | Sack | 138/110 |
| 4,360,042 | A | * | 11/1982 | Fouss et al. | 138/119 |
| 5,326,191 | A | * | 7/1994 | Wilson et al. | 405/124 |
| 5,634,311 | A | * | 6/1997 | Carlton | 52/577 |
| 5,643,311 | A | * | 7/1997 | Smith et al. | 606/193 |
| 5,746,253 | A | * | 5/1998 | Dust et al. | 138/178 |
| 5,844,169 | A | * | 12/1998 | Uemura et al. | 174/68.3 |
| 6,769,662 | B2 | | 8/2004 | Garza | |
| 2002/0170610 | A1 | * | 11/2002 | Webber | 138/28 |
| 2005/0089373 | A1 | * | 4/2005 | Simpson et al. | 405/52 |

FOREIGN PATENT DOCUMENTS

| | | | | |
|---|---|---|---|---|
| FR | 2793820 | A1 | | 11/2000 |
| JP | 09324459 | A | * | 12/1997 |

* cited by examiner

*Primary Examiner* — John Kreck
*Assistant Examiner* — Stacy Warren
(74) *Attorney, Agent, or Firm* — Maier & Maier PLLC

(57) ABSTRACT

A culvert end for a culvert includes a culvert body and a brow. The culvert body has an upper section and an outer end that defines an opening. One or more structural weaknesses are formed in the culvert body. The one or more structural weaknesses are configured and arranged to encourage a partial collapse of the upper section of the culvert body when the culvert end is subjected to a sudden end-on force caused by a vehicle impacting against the outer end of the culvert body, thereby creating a transitioning surface that enables the impacting vehicle to ride over the outer end of the culvert body. The brow is formed at the outer end of the culvert body and configured to initiate the partial collapse of the upper section when the brow is struck by the impacting vehicle.

21 Claims, 8 Drawing Sheets

Orthogonal View

End View

Orthogonal View

Side View

Top View

Side View

End View

Orthogonal View

End View

Side View

Top View

Side View

Orthogonal View

CULVERT END

TECHNICAL FIELD

This invention relates to a culvert end. In particular, the invention relates to a culvert end that decreases the severity of motor vehicle accidents wherein the culvert has an end that is deformable under impact to create a transitioning surface to reduce the likelihood of the vehicle arresting, catching or snagging itself in the entrance to the culvert.

BACKGROUND

A safe road system is one where drivers rarely leave the road; but when they do, the vehicle and roadside are both designed to help protect vehicle occupants from death or serious harm, or at least minimize the harm. There are limits to the kinetic energy exchange that humans can tolerate, during rapid deceleration associated with a crash, before serious injury or death occurs.

A key contribution to improved road safety outcomes requires that road infrastructure and hardware be designed to take into account these errors and vulnerabilities. In the event of a crash it is desirable that the crash energy is managed to tolerable levels through either cushioning the impact or redirecting the vehicle around or over the obstruction.

In the United States for 2006, there were 17,241 single vehicle run off the road (SVROR) fatalities, representing 48 percent of the total of 42,769 fatalities (1). A review of the SVROR data shows that over 90 percent of the fatalities were a consequence of inadequate roadside treatments (1). In 73 percent of the SVROR crashes, a collision with a fixed object was the first harmful event (1). The first harmful event for a further 19 percent was an overturned vehicle (1). The data from France for 2003, shows that a similar proportion of crash deaths (21 percent) were due to collisions with ditches or embankments (2).

A review of New Zealand crash data, between 2003 and 2008 inclusive, indicates that over 90 percent of all crashes involved objects being struck on the roadside (3). Sixty percent of all objects struck were ditches (3). The higher New Zealand statistics for ditch impacts may be attributable to the generally narrower roads, and more abrupt, deeper ditch cross sections.

Ideally, if a vehicle inadvertently crosses the shoulder the driver should be able to recover safely. If the driver travels onto the roadside, the probability of a crash occurring depends upon the roadside features, such as the presence and location of fixed objects, shoulder drop-off, side slopes, ditches, and trees. If the roadside is fairly flat without objects and the soil can support the vehicle weight, then the probability of a serious crash is minimal (and indeed, in many cases the driver can fully recover and there will be no SVROR crash).

Addressing SVROR crashes presents significant challenges because of the extent of road networks, variations in traffic volumes and speed, and the random occurrence of these types of crashes. Identifying and implementing cost-effective countermeasures on road networks will continue to be an ongoing challenge.

The number of SVROR crashes can be reduced through decreasing the density of roadside hazards and their proximity to the traveled way. The severity of these crashes can be reduced through decreasing the relative obstructiveness of roadside features, such as by making roadside hardware more forgiving, or modifying side slopes to prevent rollovers.

Roadside culverts present a significant danger in the event of an accident. Roads, particularly in the countryside are often bordered by a ditch. Such ditches are designed to help drain water away from the roads and other structures, preventing water damage to the road foundation as well as preventing surface flooding. In order to maintain the integrity of the drain, intersecting roads or entrance ways and the like, have a culvert, or tube, running under and across it to allow water to continue flowing along the drain. Culverts such as this generally run parallel to the main road.

In a loss of control event where the vehicle leaves the road and enters the ditch there is a high likelihood of a head on crash into an intersecting embankment and culvert end. In such situations, the vehicles kinetic energy will generally be maintained in the direction of travel. A culvert presents a significant danger as it has been established the end will often "catch" or snag a part of the vehicle, generally the bumper, wheel or part of the under carriage, causing the vehicle to arrest or roll and increasing the chances of occupant injury or death (5).

To make such culverts safer the drainage culvert ends have been made traversable; achieved through eliminating snagging hazards. Such safety ends are especially important at road locations with a high possibility of head on crashes with parallel drainage structures that are under intersecting driveways and roads.

An intersecting road embankment can also be made safer by grading the side slope to improve traversability and safety. It is desirable to achieve a slope of about 1:4 to 1:6 (i.e. vertical to horizontal dimension ratio) or flatter (4, 5).

Untreated culvert ends under driveways or median crossings are hazardous to vehicles that have left the roadway (5). AASHTO (American Association of State Highway and Transportation Officials) and Austroads recommend the use of grated culvert safety end treatments for parallel drainage culverts with diameters greater than 900 mm (4,5). At traffic volumes above 13,000 vehicles per day a grated treatment becomes a cost effective safety treatment for culvert diameters greater than 600 mm (4, 5). It is further recommended that multiple adjacent parallel drainage culverts of any diameter have the grated safety end treatments (4). Grates are recommended for cross drainage slopes when the gap exceeds one meter. Multiple cross drainage culverts perpendicular to the road with gaps greater than 750 mm require grating (4). The slope of tube inlet and outlet structures should match the adjacent side slope (4).

It is recommended that single culverts with diameters of 600 mm or less be chamfered to match the graded side slope of the intersecting road embankment (4,5).

The problem is that it is unlikely that a small to medium size vehicle with 381 mm wheel rims or less will be able to mount a 600 mm diameter or larger culvert, given that typically the outside diameter of their wheels (i.e. rim and tire) have heights in the range of 600 mm to 660 mm. The additional obstruction of a larger unprotected culvert end or a culvert headwall will make the problem increasingly insurmountable. If a vehicle at speed were to enter and track down the ditch to the culvert it is likely that the vehicle bumper, suspension, or wheel would snag on the culvert end and the vehicle would either arrest or be launched out of control.

Vehicles with smaller wheels will have an even greater risk as the culvert end hazard is a proportionally greater obstacle. The majority of the light vehicle fleet has 381 mm or smaller wheel rims, with outside wheel diameter heights of less than 600 mm. The culvert end snagging hazard is a growing problem as the proportion of small to medium size vehicles is increasing due to economic and environmental reasons.

These vehicles generally have 330 mm or 356 mm wheel rims, with an outside diameter wheel height of less than 600 mm. The effect of this trend is that increasingly smaller diameter culverts are becoming dangerous snagging hazards.

The general effect following a culvert end snag at speed will be the further loss of control due to damage to the vehicle's steering and suspension. Often this results in a severe impact on the culvert end or headwall, and/or the catastrophic flipping of the vehicle.

Current practice uses pre-cast concrete end sections with grates to reduce wheel snagging on the drainage opening. The maximum spacing of grate pipes or bars are set on 600 mm centers.

These examples are exemplified by the prior art. U.S. Pat. No. 3,587,239 illustrates a culvert construction that is beveled downwardly and outwardly and includes a grate structure of heavy construction overlying and extending the beveled area which, in the event of a vehicle impact allows the vehicle to traverse the culvert upwards, over the inclined grate.

French application number 2793820 is another example of the use of a protective grate in which the grate is produced at a sloping angle to transition the vehicle over the opening of the culvert.

A further example of an attempt to solve the problem is U.S. Pat. No. 6,769,662. This example provides a pre-cast safety end for culverts. This culvert end also has a concrete transition that guides the vehicle over the top of the culvert drain entrance to avoid the wheel engaging with the drain entrance.

All of the known culvert safety ends utilize a rigid system that is designed to withstand the impact of a vehicle and direct the vehicle over the culvert. However, they all suffer from several problems inherent to their design. In particular is the large cost and engineering difficulties associated with making and installing such a system. These structures may require heavy machinery to place the structures in place, or alternatively, large amounts of concrete and/or steel to create the appropriate deflection system. It is also a common problem for culverts and ditches to accumulate debris such as branches, dirt, gravel and other roadside detritus. This accumulation, in conjunction with a sieve like grate as given in U.S. Pat. No. 3,587,239 can cause drain blockages which require extensive and tedious maintenance. Either of these considerations may be impractical for the location for the culvert to be installed.

What is needed is a safety culvert end that assists vehicles that enter a ditch and are confronted with a culvert to safely transition out of the ditch and over the culvert without the vehicle becoming snagged on the culvert end.

It is an object of the invention to provide a culvert safety end that deforms to create a surface that transitions an errant vehicle over the culvert end or to at least provide the public with a useful alternative.

STATEMENTS OF INVENTION

In a first aspect, the invention provides a culvert end, wherein the culvert end is structurally weakened to allow partial collapse of the upper section through the impact loading of the culvert end brow.

Preferably the culvert end allows the culvert end to partially collapse under impact loading creating a transitioning surface over the culvert to support the passage of the vehicle. The impact loading may be by way of a sudden force resulting from an impact by a vehicle. The partial collapse of the weakened top half of the culvert end is initiated through the vehicle bumper or under carriage engagement of the culvert end brow. The structural weakening may be by way of one or more failure planes in the culvert end.

The invention also provides for a culvert end comprising one or more failure planes comprising a slit, a perforation, a thinned section, a section of material that is weaker than the culvert or a section of deformable or weakened material.

The culvert end may comprise one or more side failure planes located on one or both outer sides of the culvert end at a height of a half diameter of the culvert, extending from the end, parallel to the central axis of the culvert.

In one embodiment the culvert end may also comprise one side failure plane on each side of the culvert end extending from the end parallel to the central axis of the culvert.

The side failure planes may have a length that is substantially equal to half to four times the diameter of the culvert.

A further embodiment of the culvert end comprises a top failure plane on the top of the culvert end extending from the end, parallel to the central axis of the culvert.

The top failure plane may also have a length substantially equal to one quarter to two times the diameter of the culvert.

The structural weakening of the culvert end may be by way of one or more deformable materials, for example the culvert end may be made from a deformable material. The deformable material may be plastic, ceramic, fiberglass, metal or concrete.

Examples of suitable deformable plastic materials include Acrylonitrile butadiene styrene, Polyethylene, Polyvinylchloride, Polypropylene, Polyvinylidene fluoride or Polybutylene.

Examples of suitable deformable metal materials include corrugated aluminum or corrugated steel.

Examples of suitable deformable concrete materials include Bar-Wrapped or reinforced concrete.

A further embodiment of the invention provides side failure planes which comprise an angled interface.

In another embodiment the culvert end according to the present invention provides drainage continuity.

The present invention also provides for a culvert end capable of being retrofitted to a preexisting culvert.

Further, the invention also embodies a culvert comprising a culvert end as previously described.

BRIEF DESCRIPTION OF FIGURES

The invention will now be described by example only with reference to the Figures:

FIG. 3*c* shows an orthogonal view of the culvert end of FIGS. 3*a* and 3*b;* wherein;

Figure 1A:
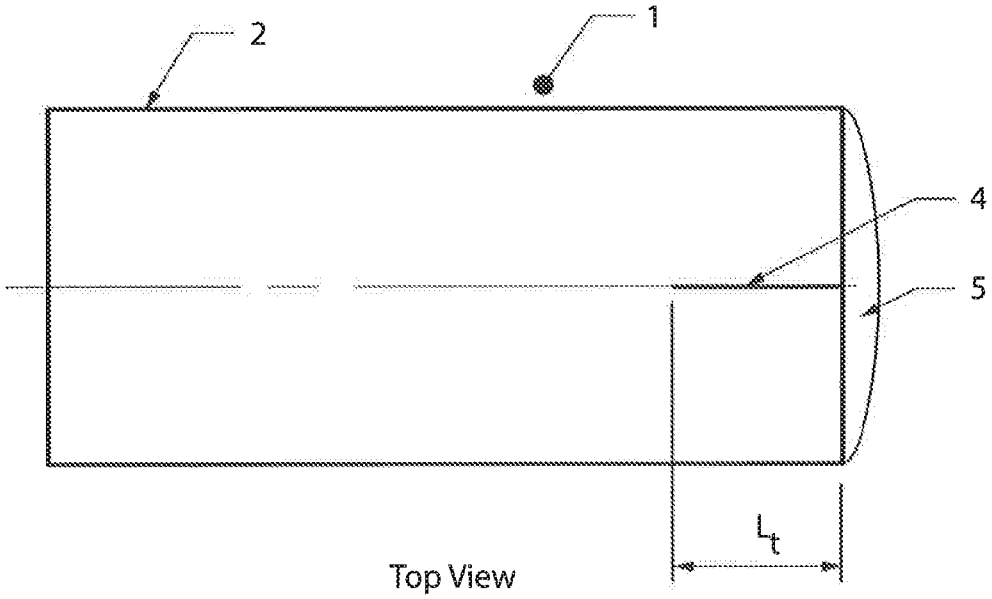
FIG. 1*a* shows a top view of an embodiment of a smooth walled culvert end according to the present invention.
Figure 1B:
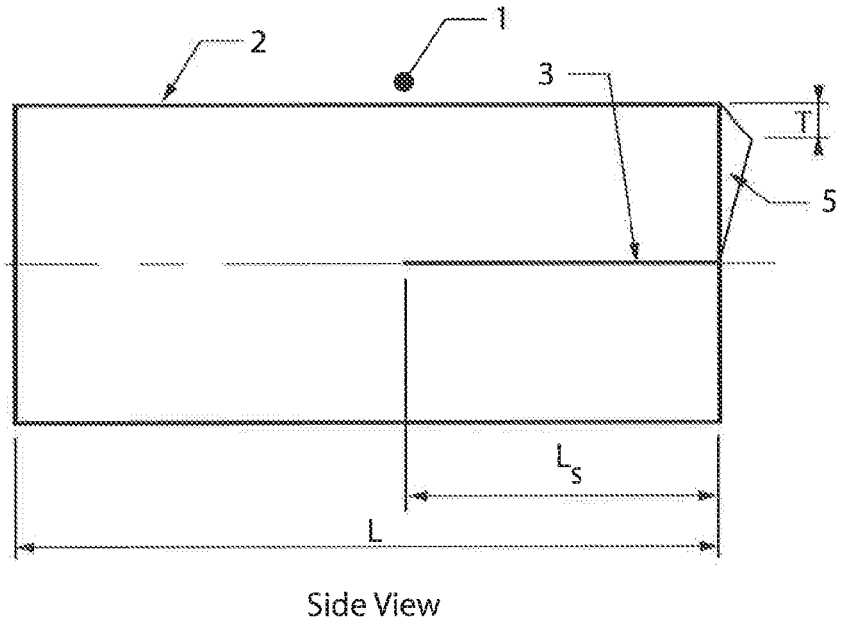
FIG. 1*b* shows a side view of the culvert end of FIG. 1*a;*
Figure 1C:
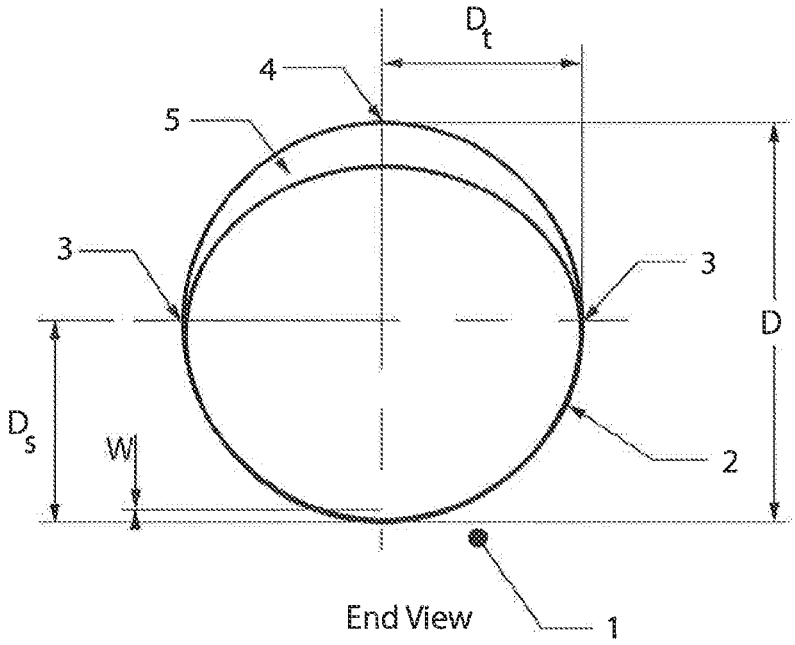
FIG. 1*c* shows an end view of the culvert end of FIGS. 1*a* and 1*b;*
Figure 1D:
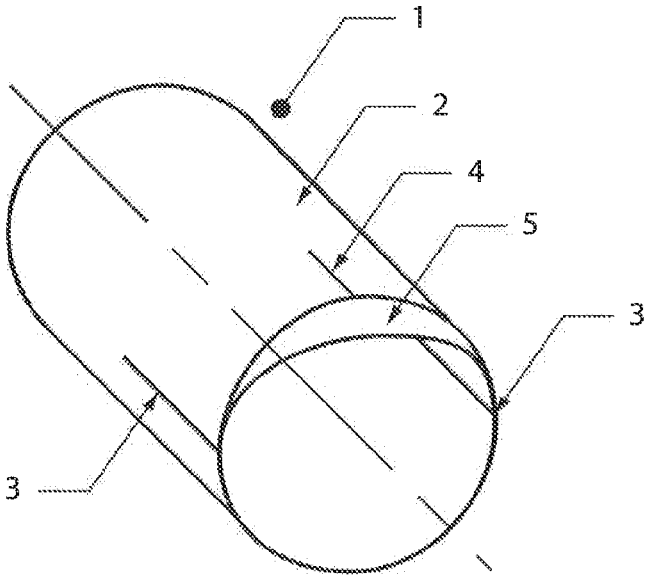
FIG. 1*d* shows an orthogonal view of the culvert end of FIGS. 1*a* to 1*c;*

D is the nominal outside diameter;

Ds is the vertical distance from the bottom to the side failure planes;

Dt is the horizontal distance from side to top failure planes;

L is the length of the culvert or culvert extension;

Ls is the length of the side failure planes;

Lt is the length of the top failure planes;

T is the brow thickness; and

W is the tube wall thickness.

DETAILED DESCRIPTION

The present inventor has found that instead of utilizing a solid rigid structure to transition a vehicle in the event of a crash, this effect can also be achieved by incorporating a weaker structural element into the upper half of the culvert end. Through end on impact loading by a vehicle in the event of an accident, the vehicle bumper, wheel or under carriage engages the culvert end brow which then initiates the partial collapse of the upper half of the culvert end. The partial collapse of the upper half of the culvert end creates a transitioning surface, and enables the vehicle to override and traverse the culvert safety end and transition onto an appropriately graded intersecting road embankment side slope. The transition will facilitate the retention of vehicle control, and avoid the bumper, undercarriage or wheel snagging on the culvert end. This will minimize damage to the vehicle suspension and steering and further loss of control.

The term culvert includes, but is not limited to any channel, drain, conduit, tunnel or the like, designed for the purpose of carrying water under a carriageway, for example a road, walkway or railway. In this situation it is also used to refer to a tube used in a road-like environment with at least one exposed end.

The weaker structural element forming the safety end may be achieved through either a weakening of the structural integrity of the end of the culvert or culvert extension through the manufacturing of predictable collapse mechanisms into it, and/or through being manufactured of a deformable material and/or structure that is adequately weaker than the balance of the main load bearing length of the culvert or extension. The collapsing of the upper weaker structural element forming the end of the culvert or extension creates a transitioning surface that enables the impacting vehicle bumper, under carriage or wheel to be supported and direct the travel of the vehicle upwards to override and traverse it, but not to the extent that the controlled collapse impedes drainage or water flow through the culvert.

It will be appreciated that any suitable material used in culvert construction, including deformable material, could be used in the present invention. Such a material has to be sufficiently rigid to the normal forces of a culvert, but will deform under sudden impact loading, for example with a vehicle, and provide a transition surface capable of supporting a vehicle's passage. Examples of suitable deformable material may include, but are not limited to, plastic, fiberglass, ceramic, metal or concrete. In particular, plastics, such as Acrylonitrile butadiene styrene, Polyethylene, Polyvinylchloride, Polypropylene, Polyvinylidene fluoride or Polybutylene, metal, such as corrugated aluminum or corrugated steel, concrete, such as Bar-Wrapped or reinforced concrete may be used in the present invention.

Those skilled in the art will appreciate that some materials are elastically deformable and others are destructively deformable. The present invention is intended to encompass embodiments that encompass both types of deformation. It is further possible to have a culvert end that is partially elastically deformable. This will particularly be the case when certain types of polyethelene pipes are used. The advantage of an elastically deformable, or partially elastically deformable, culvert end is that it allows the pipe to maintain flow of water through the pipe after an impact incident, while maintaining its safety characteristics. Also, the culvert end may be returned to substantially or approximately its original shape following an accident, thereby not requiring a new culvert or end to be installed.

In addition to the use of a deformable material to create the structural weakening is to include one or more failure planes, for example slits, in the culvert end. Such failure planes can be used to ensure that the culvert end deforms in a predicted manner under impact loading, for example, impact with a vehicle; such that the upper section at the end of the culvert will collapse downwards creating a transitional surface that will direct a vehicle upwards and over the culvert end.

Examples of how the weakening of the upper section of the culvert end can be achieved are shown in FIGS. 1*a* to 1*e*, 2*a* to 2*f*, and 3*a* to 3*c*. The culvert end 1 comprises a tube section 2 having diameter D and length L. As shown in FIGS. 1*b* to 1*d*, 2*b* to 2*e* and 3*b* to 3*c* the tube section 2 has side failure planes 3, comprising a slit, at each side, starting at the end of the tube 2 and extending parallel to the central axis of the tube 2 for a distance Ls. The side failure planes 3 are located at Ds in the horizontal plane at a height of half the diameter D of the tube 2 from the bottom and extend parallel to the central axis of the culvert end. The tube 2 also has a top failure plane 4 as shown in FIGS. 1*a*, 1*c*, 1*d*, 2*a*, 2*c*, 2*d*, 3*a* and 3*c*, starting at the end of the tube 2 and extending parallel to the central axis of the tube 2 for a distance Lt. The top failure plane 4 is located Dt on the upper part of the tube at the top most part of the tube 2 (at a height equal to the diameter of the tube), and extends parallel to the central axis of the tube and with the failure plane substantially equidistant between the side failure planes 3.

As shown in FIGS. 1*a* to 1*e*, 2*a* to 2*d*, 2*f* and 3*a* to 3*c*, the culvert end 1 incorporates a thickening, or brow 5, of the tube 2 in the upper portion of the culvert end 1. This brow increases the contact area for the impacting vehicle to engage and initiate the safety end collapse mechanism. The brow 5 can also provide strength to the upper portion and ensures the integrity of the transition plane created by the collapse of the upper portion of the tube 2 under impact. The brow enables the vehicle to gain sufficient traction on the brow to facilitate the desired collapse.

Under impact with a vehicle, it has been found that the inclusion of the side failure planes 3 and top failure plane 4 in the culvert end 1 causes the front of the upper section of the tube 2 to deform downwards, thereby creating a transitioning surface that deflects the vehicle upwards and away from the culvert end opening. In doing so the collapsing upper section of the tube 2 decreases the likelihood of the vehicle catching or snagging itself on the culvert opening, and therefore reducing the likelihood of catastrophic vehicle impact or rolling.

In one embodiment it has been found that having a Ls substantially equal to the diameter D of the tube 2 and a Lt substantially equal to half the diameter D of the tube 2 provides for the correct collapsing of the upper portion of the culvert end 1 under impact loading.

For example, in a further embodiment of the invention it has been found that having a Ls substantially equal to two times the diameter D of the tube 2 and an Lt substantially equal to half the diameter of D of the tube provides for the correct collapsing of the upper portion of the culvert end 1 under impact loading.

However, it will be appreciated that the lengths of Lt and Ls may be varied and still achieve the desired result. It will also be appreciated that the lengths of Lt and Ls can vary depending on the material the culvert end is created from, the diameter of the culvert end, the angle desired for the transition surface and other characteristics that can be determined by one skilled in the art.

It will also be understood by the skilled person that once the use of a structural weakness to create a transitional plane under impact has been appreciated, the use of other forms to create structural weaknesses, for example the use of slits, perforations, cuts, gaps, or the like, deformable material, localized use of weaker or deformable material, thinner sections in the tube 2, as well as other arrangements of using one or more failure planes will be possible, that will allow the desired collapsing of the upper section to create a transitional surface under impact. The use of all other structural weaknesses which allow the upper section of the culvert end to collapse under impact loading fall within the scope of the present invention.

Figure 1E:
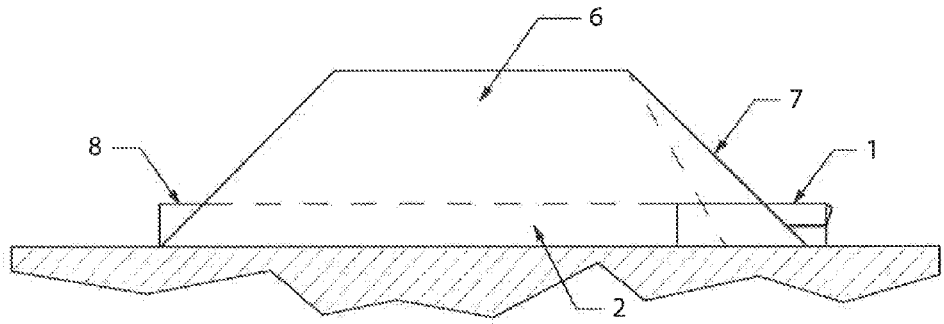
FIG. 1*e* shows a side view of an intersecting road cross section showing a typical installation of the culvert safety end of FIGS. 1*a* to 1*d;*
Figure 2A:
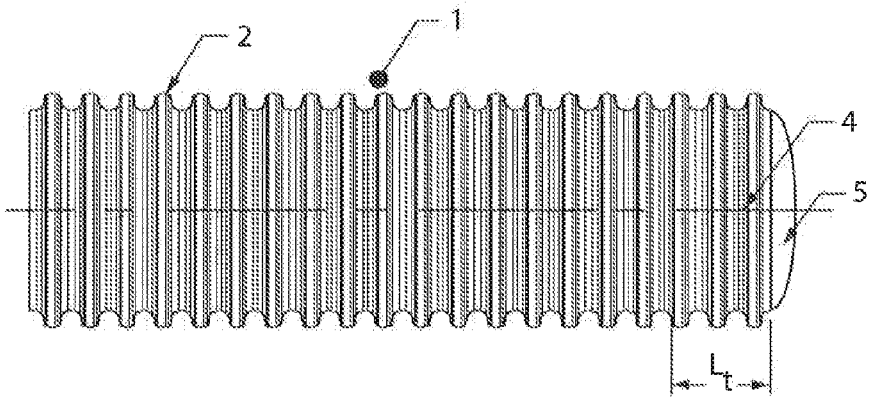
FIG. 2*a* shows a top view of an embodiment of a culvert end in corrugated plastic pipe.
Figure 2B:
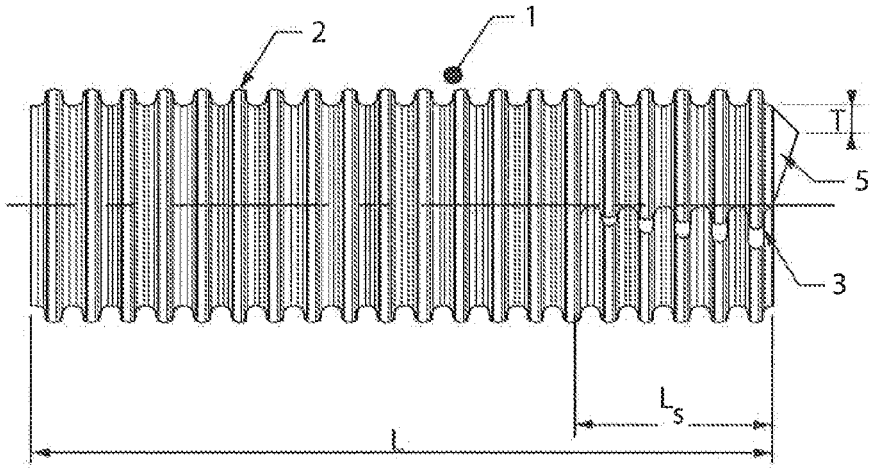
FIG. 2*b* shows a side view of an embodiment of a culvert end of FIG. 2*a;*
Figure 2C:
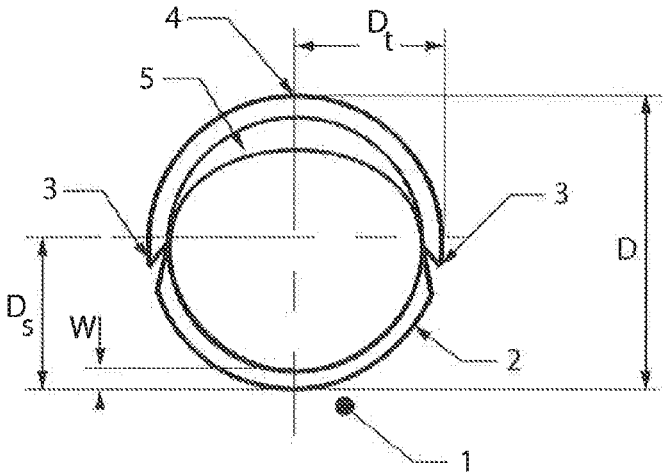
FIG. 2*c* shows an end view of the culvert end of FIGS. 2*a* and 2*b* having angular slits.
Figure 2D:
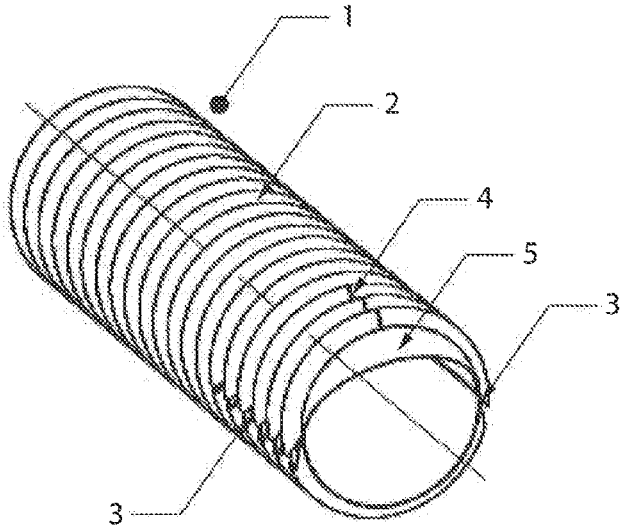
FIG. 2*d* shows an orthogonal view of an embodiment of a culvert end of FIGS. 2*a* to 2*c;*
Figure 2E:
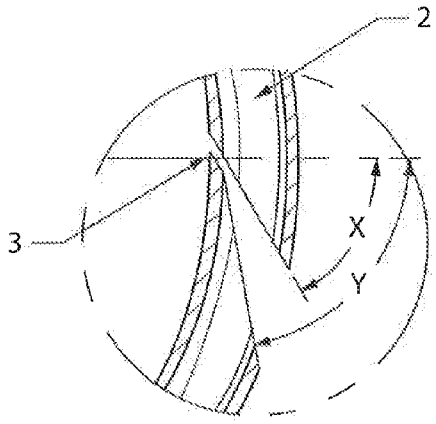
FIG. 2*e* shows a detailed enlargement of the end view of FIG. 2*c;*
Figure 2F:
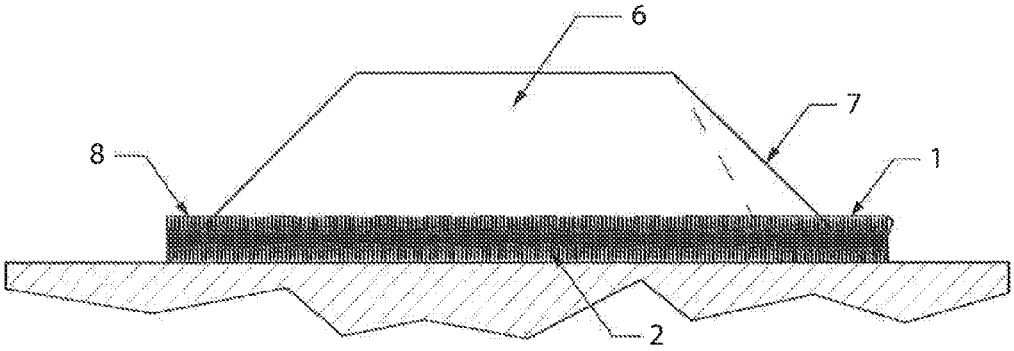
FIG. 2*f* shows a side view of an intersecting road cross section showing a typical installation of the culvert safety end of FIGS. 2*a* to 2*e;*
Figure 3A:
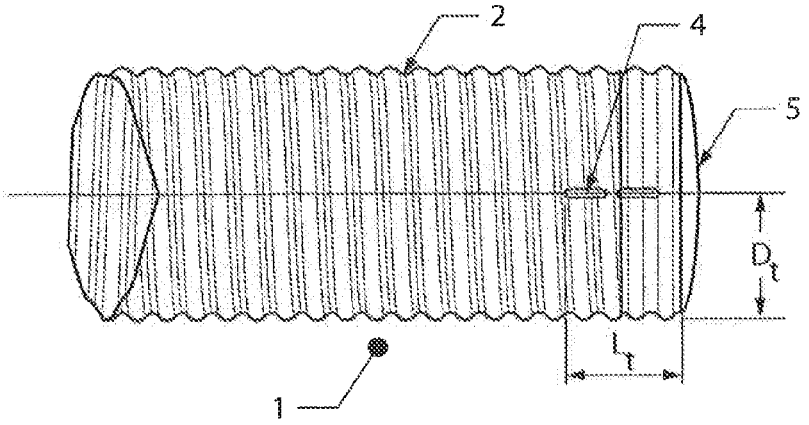
FIG. 3*a* shows a top view of an embodiment of a culvert end in corrugated metal pipe incorporating perforations.
Figure 3B:
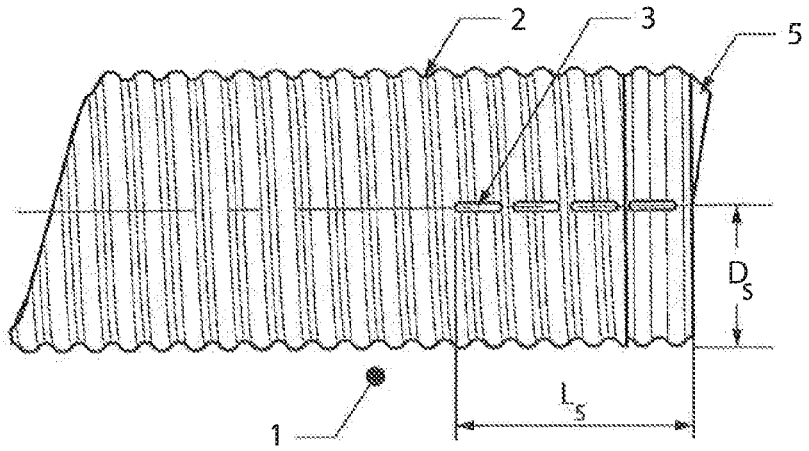
FIG. 3*b* shows a side view of the culvert end of FIG. 3*a;*
Figure 3C:
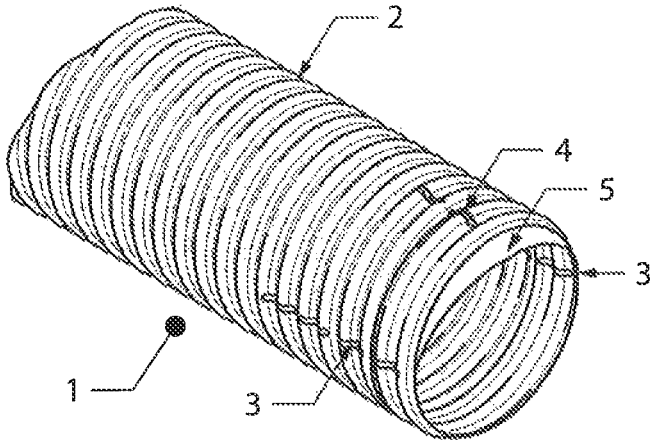

FIGS. 1*b* to 1*d*, 2*b* to 2*e* and 3*b* to 3*c* show different embodiments of the invention with different examples of side failure planes. FIGS. 1*a* to 1*d* show a straight edged failure plane utilizing a slit, FIGS. 2*b* to 2*e* show a straight edged failure plane incorporating an angled failure plane and FIGS. 3*b* to 3*c* show failure planes utilizing perforations. FIGS. 1*a* to 1*e* show a smooth walled embodiment of the invention, the smooth wall can be created utilising any material known to one skilled in the art that can be formed into a pipe; for example, concrete, metal or plastic. FIGS. 2*a* to 2*f* and 3*a* to 3*c* show embodiments of the invention wherein the walls of the culvert end are corrugated. This is particularly embodied by corrugated plastic or corrugated metal. In particular, corrugated polyethylene.

In a further embodiment, the side failure planes 3 can comprise an angled interface at the side failure planes 3 as shown in FIGS. 2*c* and 2*e*. This provides a mechanism to allow the upper part of the side failure plane 3 of the culvert end to more easily slide past the lower part of the side failure plane 3 on impact loading. The side failure planes 3 may lie with an interface parallel to each other, however, the angle of the side failure plane may range between 0° from horizontal and 90° from horizontal. In a particular embodiment the upper part of the side failure plane may be cut X between 0° and 90°, more preferably between 20 and 80°, more preferably 40° and 70°, more preferably between 50° and 70°, and most preferably 60° below the plane of horizontal and the lower part of the side failure plane may be cut Y at between 0° and 90°, more preferably between 20 and 85°, more preferably 40° and 82°, more preferably between 60° and 82°, and most preferably 80° below the plane of horizontal.

It will be appreciated that the present invention can be constructed as a continuous length of tubing, which incorporates the structural weakening at either one end or both ends, and constitutes the entire culvert. This provides for a much easier product that can be built as a single unit that can easily be installed when the drain is being constructed. Alternatively, the present invention can be constructed as a shorter end section that can be attached to a culvert, either during construction, or retrofitted to an already existing culvert.

A culvert end is the end element of a culvert or culvert extension of a similar shape and size to the culvert, so that drainage flow capacity is not unduly compromised. An extension of the same diameter as the culvert could be transitioned to it. An extension with a larger diameter than the culvert could be sleeved over, or transitioned to the culvert. An extension made of a suitable material to provide the necessary safety end performance, and minimize the effects on flow capacity through having thinner walls, could either be sleeved into, or transitioned to the culvert.

FIGS. 1*e* and 2*f* show a cross section of a culvert tube in situ in an embankment of an intersecting road or driveway. The embankment 6 has a sloped and graded side 7. In the Figures, a culvert end 1 according to the present invention can either be retrofitted to a previously exposed end 8 of an existing culvert tube 2, or be of unitary manufacture into a new culvert pipe.

The presently claimed culvert end provides for the benefit that under impact with a vehicle, the vehicle is able to pass safely over the culvert end. This significantly reduces the crash impact forces of striking an unprotected culvert end.

It also has the benefit that it can be produced easily as a culvert extension, that can be quickly and easily (i.e. less expensive) retrofitted to an unprotected culvert end. Furthermore, the culvert extension could be readily replaced if vehicle override impact damage was excessive, with little effect to the main culvert crossing.

The claimed culvert end also has the advantage that, because the end extends from the bank, it shields the culvert inlets from falling loose material and debris that would impede roadside drainage, as happens with chamfered or grated culvert ends. The absence of a bolted down grated end treatment on a culvert with a safety end will make routine removal of any debris faster and easier (i.e. less expensive). Therefore the present culvert end does not require the same level of maintenance.

Although the invention has been described by way of example, it should be appreciated that variations and modifications may be made without departing from the scope of the invention. Furthermore, where known equivalents exist to specific features, such equivalents are incorporated as if specifically referred in this specification.

Unless the context clearly requires otherwise, throughout the description and the claims, the words "comprise", "comprising", and the like, are to be construed in an inclusive sense as opposed to an exclusive or exhaustive sense, that is to say, in the sense of "including, but not limited to.

REFERENCES (1) Bahar G. B, Roadway Departure Crashes: How Can They Be Reduced, ITE Journal, December 2008

(2) France a star in road safety, Road Marking News, April 2008

(3) Crash Analysis System, New Zealand Ministry of Transport, February 2009

(4) Roadside Design Guide, American Association of State Highway and Transportation Officials, 2002

(5) Guide To Road Design Part 6, Austroads, 2009.

The invention claimed is:

1. A culvert end for a culvert, the culvert end comprising:

a culvert body having an upper section and an outer end that defines an opening, the outer end of the culvert body having a brow;

one or more structural weaknesses being formed in the culvert body and being configured to partially collapse the upper section of the culvert body when the culvert end is subjected to a sudden end-on force caused by a vehicle impacting against the outer end of the culvert body at the brow, wherein the partially collapsed upper section of the culvert body creates a transitioning surface that enables the vehicle to ride over the outer end of the culvert body.

2. The culvert end according to claim 1, wherein the one or more structural weaknesses comprise one or more failure planes formed in the culvert body.

3. The culvert end of claim 2, wherein the one or more failure planes comprises a slit, a perforation, a thinned section, a weakened section in the culvert body, or a section of deformable material.

4. The culvert end of claim 2, wherein the one or more failure planes comprises one or more side failure planes located on each side of the culvert body, the one or more side failure planes extending from the outer end and parallel to a central axis of the culvert body.

5. The culvert end of claim 4, wherein there is one side failure plane located on each side of the culvert body.

6. The culvert end of claim 4, wherein the side failure planes formed on the sides of the body are generally symmetrical about a vertical plane that passes through the central axis of the culvert body.

7. The culvert end of claim 4, wherein the side failure planes have a length substantially equal to between half and four times a diameter of the culvert body.

8. The culvert end of claim 4, wherein the side failure planes are located in a horizontal plane at a height of half a diameter of the culvert body from a bottom of the culvert body.

9. The culvert end of claim 4, wherein the side failure planes each comprise an angled interface.

10. The culvert end of claim 2, wherein the one or more failure planes comprises a top failure plane located on a top of the culvert body, the top failure plane extending from the outer end and being parallel to a central axis of the culvert body.

11. The culvert end of claim 10, wherein the top failure plane has a length substantially equal to between a quarter and two times a diameter of the culvert body.

12. The culvert end of claim 10, wherein the top failure plane is located substantially equidistant between corresponding side failure planes located on opposite sides of the culvert body.

13. The culvert end of claim 2, wherein the brow comprises a thickened part of a wall of the culvert body.

14. The culvert end of claim 1, wherein the brow comprises a thickened part of a wall of the culvert body.

15. The culvert end of claim 1, wherein the brow extends axially out over the opening and downwardly to force an impacting vehicle over the outer end of the culvert body to facilitate the partial collapse of the upper section and create the transitioning surface.

16. The culvert end of claim 1, wherein the culvert end is made from a deformable material.

17. The culvert end of claim 16, wherein the deformable material is plastic, ceramic, fiberglass, metal, concrete, corrugated aluminum, corrugated steel, Bar-Wrapped deformable concrete or reinforced concrete.

18. The culvert end of claim 17, wherein the plastic is Acrylonitrile butadiene styrene, Polyethylene, Polyvinylchloride, Polypropylene, Polyvinylidene fluoride or Polybutylene.

19. The culvert end of claim 1, wherein the culvert end is configured to be retrofitted to an existing culvert.

20. A culvert comprising a culvert end according to claim 1.

21. A culvert comprising a culvert end according to claim 1, wherein the culvert and the culvert end are formed as a unitary member.

* * * * *